United States Patent [19]

Burton

[11] Patent Number: 4,569,340

[45] **Date of Patent: * Feb. 11, 1986**

[54] GRAVITY TRACTION VEST

[75] Inventor: Charles V. Burton, Excelsior, Minn.

[73] Assignee: Abbott-Northwestern Hospital, Inc., Minneapolis, Minn.

[ * ] Notice: The portion of the term of this patent subsequent to Dec. 27, 2000 has been disclaimed.

[21] Appl. No.: 591,466

[22] Filed: Mar. 20, 1984

[51] Int. Cl.[4] ..... A68H 1/02

[52] U.S. Cl. ..... 128/75; 128/78

[58] Field of Search ..... 128/75, 78, 84 R, 87 B, 128/89 R, 90, 101

[56] References Cited

U.S. PATENT DOCUMENTS

| | | | |
|---|---|---|---|
| 2,774,349 | 12/1956 | Judovich . | |
| 2,812,010 | 11/1957 | Abdallah | 272/70 A |
| 4,202,327 | 5/1980 | Glancy | 128/90 X |
| 4,205,665 | 6/1980 | Burton . | |
| 4,269,179 | 5/1981 | Burton et al. . | |
| 4,422,452 | 12/1983 | Burton . | |
| 4,524,763 | 6/1985 | Eberling, Jr. | 128/75 |

OTHER PUBLICATIONS

Brochure: *The Sister Kenny Institute Gravity Lumbar Reduction Therapy Program,* Authors: Charles Burton, M.D. and Gail Nida, R.N.

*Primary Examiner*—Richard J. Apley
*Assistant Examiner*—Alan W. Cannon
*Attorney, Agent, or Firm*—Merchant, Gould, Smith, Edell, Welter & Schmidt

[57] ABSTRACT

A gravity traction vest for secure attachment to a patient is disclosed. The patient has a torso with a rib cage having a plurality of ribs including a lowest rib, the rib cage forming at its front a generally inverted U shaped area. The vest (10) is adapted to be secured to the patient and attached to a support structure, whereby the patient is suspended from the support structure with the head of the patient in a generally upward direction. The vest (10) includes a torso surrounding member (11) having a first section (12) and a second section (13). The sections (12) and (13) are constructed of a rigid material and the first section (12) is shaped to surround a first side of the torso and the second section (13) is shaped to surround a second side of the torso. The back edge (12*a*) of the first section (12) is cooperatively connected to the back edge (13*a*) of the second section (13). A cam over center lock (19) connects the first section (12) to the second section (13), whereby the torso surrounding member (11) is attached to the patient. Straps (22) and (23) are secured to support members (20) that are secured to the torso surrounding member (11). These are adapted to be attached to a support structure for suspending the member (11) from the support structure and applying a uniform force on the member in an upward direction. In a preferred embodiment, the bottom edges (12*d*) and (13*d*) have a flanged under portion (14) and (15) that protrude inwardly toward the patient for engagement below both the lowest rib and the inverted U shaped area of the rib cage, wherein when the vest (10) is attached to the patient's rib cage, substantially the entire flanged under portion (14) and (15) is positioned inwardly toward the patient. The vest (10) also includes a foam liner (21).

16 Claims, 4 Drawing Figures

GRAVITY TRACTION VEST

FIELD OF THE INVENTION

This invention refers generally to vests for therapeutically treating patients suffering from back illnesses such as improperly aligned or displaced vertebral elements. More specifically, this invention relates to an improved gravity traction vest having a rigid torso surrounding member and a flanged under portion for engagement below the lowest rib of the patient and also the inverted u-shaped area of the rib cage.

BACKGROUND OF THE INVENTION

Back pain is a common and significant mallady afflicting large numbers of people and virtually every country of the world. The wide spread nature of the problem has been highlighted in numerous articles printed in both medical and news periodicals. Illustrative are articles entitled *Bare-bones Facts About Your Aching Back* from the December, 1980 issue of *Readers Digest* and the cover story from the July 14, 1980 issue of *Time* magazine.

Axial traction can be effected to alleviate certain types of back ailments. Such traction has been found to be an effective means of reducing improperly aligned or displaced vertebral elements as well as their associated invertebral discs and soft tissues. Certain circumstances have, however, long present obstacles to the effective application of controlled traction to the lumbar area. These circumstances include the significant amount of force which must be applied and the lack of a location at which the axially directed force can be applied.

In 1971, the applicant provided for the construction of an apparatus to support a patient, having one of a number of conditions such as a protruded lumbar disc, in a vertical position wherein the torso of the patient was suspended by a chest harness encircling the rib cage. As a result of the research, the applicant concluded that the rib cage could serve as an optimum site of fixation. He determined that, in order for the harness to function most effectively, it must, at its lower end, be tightened beneath the rib cage so that, as axial force is applied to the harness, the rib cage will not slide therethrough.

After continued research in this area, the applicant invented an improved gravity traction vest. Prior to this time, the tightening of a lower most belt of the gravity vest was accomplished exclusively by providing a belt having a sufficient number of locking points whereby the belt could be tightened so that it was within the perimeter of the rib cage regardless of the size of the patient being treated. Applicant invented the new improved gravity traction vest that provided means whereby axial fixation could be efficiently accomplished, yet wherein the treatment is not rendered uncomfortable. Applicant filed a patent application Ser. No. 299,679 on Sept. 8, 1981 for the improved gravity traction vest. This application was allowed on Aug. 17, 1983 and has been granted U.S. Pat. No. 4,422,452.

Applicant herein incorporates by reference U.S. Pat. No. 4,422,452.

While the improved second generation gravity traction vest provided improvement over the original gravity traction vest, there remained a number of problems associated with its use. These problems included the need to tighten a number of cinctures to secure the vest to the patient, the rough surfaces of the cinctures being felt through the vest by the patient. While there was an improved locking of the vest to the patient due to the cushion insert, it was desirable to provide for still more positive locking.

It is these problems in the prior art that the third generation gravity traction vest of the present application is directed. It provides for a torso surrounding member being constructed of the rigid material, a simple and effective means for securing the vest to the patient and a flanged under portion that protrudes inwardly toward the patient for engagement below both the lowest rib and the inverted u-shaped area of the rib cage.

SUMMARY OF THE INVENTION

An improved gravity traction vest is disclosed. The gravity traction vest is for secure attachment to a patient. The patient has a torso with a ribcage having a plurality of ribs including a lowest rib. The rib cage forms at its front a generally inverted U shaped area. The vest is adapted to be secured to the patient and is attached to a support structure, whereby the patient is suspended from the support structure with the head of the patient in a generally upward direction. The vest includes a torso surrounding member having a first section and a second section. The sections are constructed of a rigid material. The first is shaped to surround a first side of the torso and the second section is shaped to surround a second side of the torso. The sections have a back edge, front edge, top edge and bottom edge. Means for cooperatively connecting the back edge of the first section to the back edge of the second section are provided. Also provided are means for releasably connecting the front edge of the first section to the front edge of the second section, whereby the torso surrounding member is attached to the patient. Support means are cooperatively connected to the member and adapted to be attached to the support structure for suspending the member from the support structure and applying a uniform force on the member in an upward direction.

In a preferred embodiment, the bottom edges of said sections have a flanged under portion along at least a portion of the bottom edges protruding inwardly toward the patient for engagement below both the lowest rib and the inverted U shaped area of the rib cage, wherein when the vest is attached above the patient's rib cage, substantially the entire flanged under portion is positioned inwardly toward the patient to a position wherein the flanged under portion will restrain movement caused by the force applied by the support means.

DETAILED DESCRIPTION OF THE PREFERRED EMBODIMENT

Figure 1:
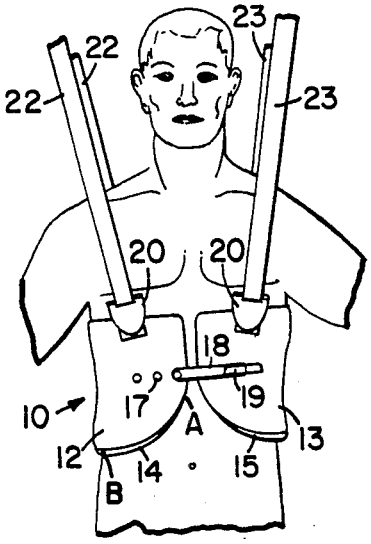
FIG. 1 is a front plan view of the gravity traction vest according to the present invention secured to a patient.
Figure 2:
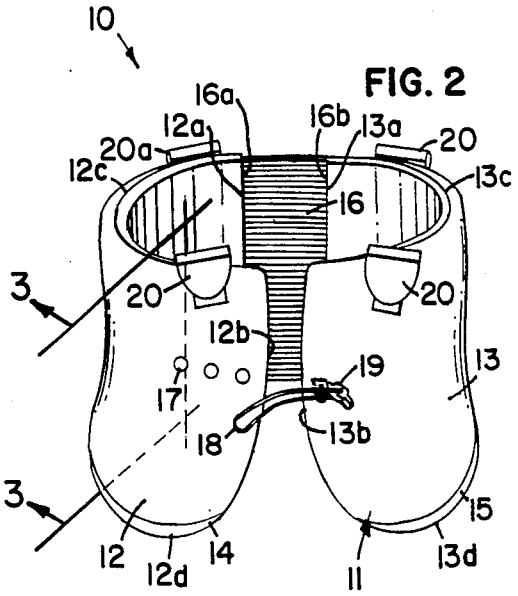
FIG. 2 is a perspective view of the gravity traction vest of FIG. 1.

Referring to the drawings, wherein like numerals reference like parts throughout the several views, there is generally designated as 10 in FIGS. 1 and 2 an improved gravity traction vest. The gravity traction vest 10 is for secure attachment to the torso of a patient. The human body has a torso with a rib cage having a plurality of ribs including a lowest rib. The rib cage forms at its front a generally inverted U shaped area. This area is the abdominal area underneath the sternum bounded by the floating ribs. The vest 10 is adapted to be secured to the patient and attached to a support structure. The patient is suspended from the support structure with the head of the patient in a generally vertical upward direction. U.S. Pat. No. 4,422,452, that has been incorporated by reference, clearly points out the specific support structure and method of suspension.

The vest 10 includes a torso surrounding member 11. The torso surrounding member 11 has a first section 12 and a second section 13. The first section 12 has a back edge 12*a*, front edge 12*b*, top edge 12*c* and bottom edge 12*d*. Similarly, the second section 13 has a back edge 13*a*, front edge 13*b*, top edge 13*c* and bottom edge 13*d*. Preferably, the sections 12 and 13 are constructed of a rigid material, such as a thermo-modifiable plastic. The sections 12 and 13 are shaped to surround the torso. Specifically, the inner surfaces of sections 12 and 13 will generally conform to the contour of the torso. In a preferred embodiment, the first section 12 is shaped to surround the right side of the torso and the second section 13 is shaped to surround the left side of the torso.

Figure 3:
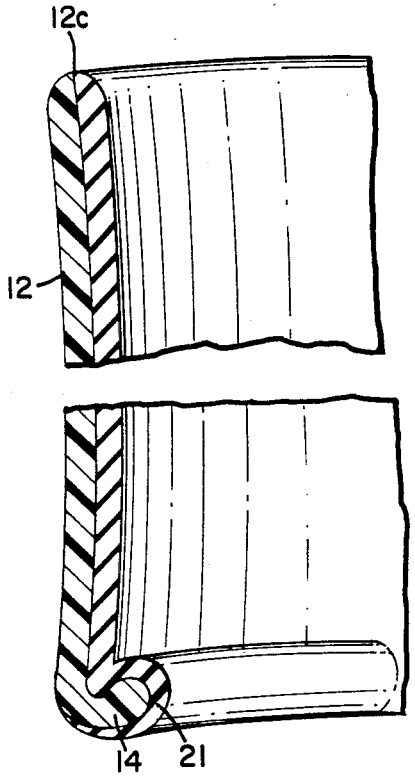
FIG. 3 is a cross-sectional view taken generally along the lines 3—3 of FIG. 2.

The bottom edges of the sections 12 and 13 have a flanged under portion 14 and 15. As can be more clearly seen in FIG. 3, the flanged under portion 14 protrudes inwardly toward the patient for engagement below the lowest rib. As can be seen in FIG. 1, the flanged under area also continues part way up the front edge 12*b* of the first section 12. This portion of the flanged under area 14 engages the inverted U shaped area of the rib cage, wherein when the vest is attached to the patient's rib cage, substantially the entire flanged under portion is positioned inwardly toward the patient to a position wherein the flanged under portion 14 and 15 will restrain movement of the member 11 caused by the force applied by the support means. The flanged under portion is anatomically correct in that it engages below the lowermost rib and upward below the floating rib. Therefore, unlike the prior art devices, the vest is supported on the patient under both the lowest rib and the floating ribs. Typically, the flanged under portion will extend from point A to point B, as shown in FIG. 1. Also, the flanged under protion is tapered to provide a smooth transition as it reaches point B. Of course, the flanged under portion would extend along a comparable portion of the second section 13.

A foam liner 21 is cooperatively connected to the inner surface of the first section 12 and the inner surface of the second section 13. The foam liner 21 makes the vest 10 more comfortable when secured to the patient.

Means for cooperatively connecting the back edge 12*a* of the first section 12 to the back edge 13*a* of the second section 13 is provided. In a preferred embodiment, an elastic material 16 having a first edge 16*a* and second edge 16*b* cooperatively connects the back edges 12*a* and 13*a* of the first section 12 and the second section 13. One method of cooperatively connecting the elastic material is to form a V-shaped slot in the back edges 12*a* and 13*a*. The first edge 16*a* is placed in the V-shaped slot in the back edge 12*a* and the V-shaped slot is then pinched closed, securing the first edge 16*a*. The second edge 16*b* is similarly secured in the V-shaped slot in the back edge 13*a*. The elastic material 16 may be suitably connected to the sections 12 and 13 by methods well known in the art. The elastic material 16 has a first width when not stretched and a second width when fully stretched. Preferably, the second width is less than two inches greater than the first width, and in a preferred embodiment, the second width is less than one inch greater than the first width. The elastic material 16 is both soft and stretchable over the vertabrae of the patient. However, the elasticity must be limited to some extent or the vest 10 will not fit sufficiently tight over the patient.

Figure 4:
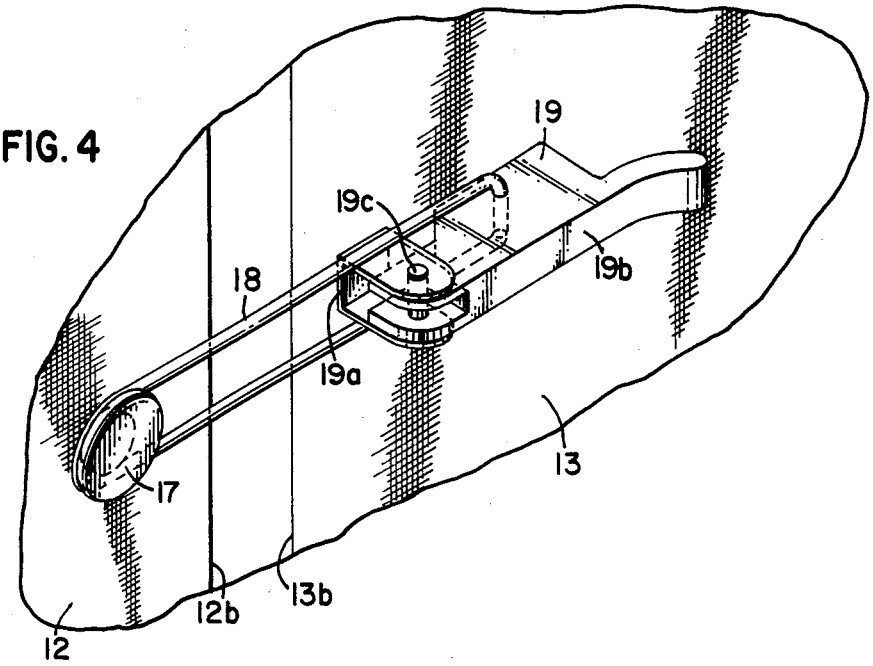
FIG. 4 is an enlarged perspective view of the cam over center lock as shown in FIG. 2.

A cam over center lock 19 provides a means for releasably connecting the front edge 12*b* of the first section 12 to the front edge 13*b* of the second section 13, whereby the torso surrounding member 11 is attached to the patient. It is understood that any suitable releasably connecting means may be used. As shown in FIG. 2, a plurality of circular fasteners are cooperatively connected to the first section 12 at spaced intervals. As shown in FIG. 4, the cam over center lock 19 is cooperatively connected to the second section 13. The cam over center lock 19 is of a construction well known.

The lock 19 includes a bifurcated base 19*a* cooperatively connected to the second section 13. A lever 19*b* is pivotally mounted by a pin 19*c* to a slot formed in the bifurcated base 19*a*. A loop member 18, is cooperatively connected to the lever 19*b*.

Support means are cooperatively connected to the torso surrounding member 11 at appropriate intervals and are adapted to be attached to a support structure for suspending the member 11 from the support structure and applying a uniform force on the member 11 in an upward direction. While straps 22 and 23 may be permanently secured to the vest 10, as taught in U.S. Pat. No. 4,422,452, in a preferred embodiment, the strap 22 and 23 correspond to the straps 44 and 46 of U.S. Pat. 4,422,452. As shown in FIGS. 1 and 2, the support means includes support members 20 that are secured to the first section 12 and second section 13. The support members 20 have a hook portion 20*a* for receiving a mating hook portion that is connected to both the strap 22 and 23.

As previously stated, the releasably connecting means is connected to the outer surface of the torso surrounding member 11 and the sections 12 and 13. Since the sections 12 and 13 are rigid, the pressure that is applied by the cam over center lock in securing the first section 12 to the second section 13 is spread over the entire outer area of the sections 12 and 13. It is therefore not directly or sharply sensed by the patient. This is in contrast to the prior art vests that were secured by velcro fasteners. The velcro fasteners were able to be sensed directly by the patient when the cinctures were tightened. This provided for discomfort to the patient.

In operation, the gravity traction vest 10 is simply fastened to the patient by securing the first section 12 to the second section 13 with the cam over center lock 19. The loop 18 is placed over one of the three circular fasteners 17, depending on the size of the patient, and the lever 19*b* is moved to its locked position, as shown in FIG. 4. This simply and effectively secures the gravity traction vest 10 to the patient. The straps 22 and 23 are then secured to the hook portion 20*a* the support members 20. However, as previously stated, it is possible for the straps 22 and 23 to form an integral portion of the gravity traction vest 10. The straps 22 and 23 are then secured to the support structure as described in my issued U.S. Pat. No. 4,422,452. The flanged under portions 14 and 15 protrude inwardly toward the patient for engagement below both the lowest rib and also below the floating ribs in the inverted U shaped area of the rib cage.

The flanged under portions 14 and 15 make the gravity traction vest 10 more anotomically correct, and provide for a better fixation of the gravity traction vest 10 to the patient. Additional benefits of the gravity traction vest 10 are that the elastic material 16 provides for a soft and stretchable material against the vertebrae. In addition, the vest is much easier to put on and off than the prior art devices. It is only necessary to make one snap, as opposed to securing a number of cinctures. Finally, because the sections 12 and 13 are made of a rigid material, any rough surfaces on the locking mechanism 19 are not directly transmitted to the patient. This is unlike the prior art velcro fasteners wherein the velcro fasteners were a cause of discomfort to the patient when the cinctures were sufficiently tightened.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

What is claimed:

1. A gravity traction vest for secure attachment to a patient, the patient having a torso with a rib cage having a plurality of ribs including a lowest rib, the rib cage forming at its front a generally inverted U shaped area, said vest adapted to be secured to the patient and attached to a support structure, whereby the patient is suspended from the support structure with the head of the patient in a generally upward direction, said vest comprising (a) a torso surrounding member having a first section and a second section, said sections constructed of a rigid material and said first section shaped to surround a first side of the torso and said second section shaped to surround a second side of the torso, said sections each having a back edge, front edge, top edge and bottom edge;

(b) means for cooperatively connecting said back edge of said first section to said back edge of said second section;

(c) means for releasably connecting said front edge of said first section to said front edge of said second section, whereby said torso surrounding member is attached to the patient;

(d) support means cooperatively connected to said member and adapted to be attached to the support structure for suspending said member from the support structure and applying a uniform force on said member in said upward direction; and (e) wherein said bottom edges have a flanged under portion along at least a portion of said bottom edges protruding inwardly toward the patient for engagement below both the lowest rib and the inverted U shaped area of the rib cage, wherein when said vest is attached about the patient's rib cage, substantially said entire flanged under portion is positioned inwardly toward the patient to a position wherein said flanged under portion will restrain movement of said member caused by the force applied by said support means.

2. The vest of claim 1, further comprising a foam liner cooperatively connected to said member wherein when said vest is worn by the patient, said foam liner is between said member and the patient.

3. The vest of claim 1, wherein said cooperatively connecting means comprises an elastic material having a first width when not stretched and a second width when fully stretched.

4. The vest of claim 3, wherein said second width is less than two inches greater than said first width.

5. The vest of claim 3, wherein said second width is less than one inch greater than said first width.

6. The vest of claim 1, wherein said sections are molded plastic.

7. The vest of claim 6, wherein said plastic is thermomodifiable.

8. The vest of claim 1, wherein said releasably connecting means comprises a cam over center lock.

9. The vest of claim 1, wherein said sections have an outer surface and said releasably connecting means is cooperatively connected to said outer surfaces, whereby said rigid members prevent said releasably connecting means from being sensed by the patient.

10. A gravity traction vest for secure attachment to a patient, the patient having a torso with a rib cage having a plurality of ribs including a lowest rib, the rib cage forming at its front a generally inverted U shaped area, said vest adapted to be secured to the patient and attached to a support structure, whereby the patient is suspended from the support structure with the head of the patient in a generally upward direction, said vest comprising:

(a) a torso surrounding member having a first section and a second section, said sections constructed of a rigid material and said first section shaped to surround a first side of the torso and said second section shaped to surround a second side of the torso, said sections each having a back edge, front edge, top edge and bottom edge;

(b) an elastic material having a first edge and a second edge, said first edge cooperatively connected to said back edge of said first section and said second edge cooperatively connected to said back edge of said second section;

(c) means for releasably connecting said front edge of said first section to said front edge of said second section, whereby said torso surrounding member is attached to the patient;

(d) support means cooperatively connected to said member and adapted to be attached to the support structure for suspending said member from the support structure and applying a uniform force on said member in said upright direction;

(e) said bottom edges have a flanged under portion along at least a portion of said bottom edges protruding inwardly toward the patient for engagement below both the lowest rib and the inverted U shaped area of the rib cage, wherein when said vest is attached about the patient's rib cage, substantially said entire flanged under portion is positioned inwardly toward the patient to a position wherein said flanged under portion will restrain movement of said member caused by said force applied by said support means;

(f) a foam liner cooperatively connected to said member wherein said vest is worn by the patient, said foam liner is between said member and the patient; and (g) said sections are molded from a thermomodifiable plastic.

11. A gravity traction vest for secure attachment to a patient, the patient having a torso with a rib cage having a plurality of ribs including a lowest rib, the rib cage forming at its front a generally inverted U shaped area, said vest adapted to be secured to the patient and attached to a support structure, whereby the patient is suspended from the support structure with the head of the patient in a generally upward direction, said vest comprising:

(a) a rigid torso surrounding member having top and bottom edges and inner and outer surfaces for encircling the torso and rib cage of the patient;

(b) support means cooperatively connected to said member and adapted to be attached to the support structure for suspending said member from the support structure and applying a uniform force on said member in said upward direction;

(c) means for releasably connecting said member around the torso; and (d) comprising said bottom edge having a flanged under portion along at least a portion of said bottom edge protruding inwardly toward the patient for engagement below the lowest rib when said vest is attached about the patient's rib cage, wherein when said vest is attached about the patient's rib cage, substantially said entire flanged under portion is positioned inwardly toward the patient to a position wherein said flanged under portion will restrain movement of said member caused by the force applied by the support means.

12. The vest of claim 11, further comprising a foam liner cooperatively connected to said member wherein when said vest is worn by the patient, said foam liner is between said member and the patient.

13. The vest of claim 11, wherein said member is molded from plastic.

14. The vest of claim 13, wherein said plastic is thermo-modifiable.

15. The vest of claim 11, wherein said sections have an outersurface and said releasably connecting means is cooperatively connected to said outer surfaces, whereby said rigid members prevent said releasably connecting means from being sensed by the patient.

16. A method of suspending a patient being treated by gravity lumbar reduction therapy, using the vest of claim 1, said method including the steps of encircling the rib cage and a portion therebelow of the patient with a vest having a flanged under bottom edge protruding inwardly toward the patient for engagement below the lowermost rib and the inverted U shaped area of the rib cage of the patient and having first and second sections constructed of a rigid material and having a means for releasably connecting said first and second sections, securing the vest about the rib cage by tightening said connecting means, and suspending the patient from a support structure with the head of the patient in an upward direction by suspending the vest from the support structure, wherein upward movement of the vest in relation to the torso of the patient is restrained by said flanged edge.

* * * * *